US011075040B2

(12) United States Patent
Lell

(10) Patent No.: US 11,075,040 B2
(45) Date of Patent: Jul. 27, 2021

(54) ELECTRICAL INTERRUPTER SWITCHING ELEMENT HAVING PASSIVE INTERRUPTION TRIPPING, IN PARTICULAR FOR INTERRUPTING HIGH CURRENTS AT HIGH VOLTAGES

(71) Applicant: Peter Lell, Moosburg (DE)

(72) Inventor: Peter Lell, Moosburg (DE)

( * ) Notice: Subject to any disclaimer, the term of this patent is extended or adjusted under 35 U.S.C. 154(b) by 0 days.

(21) Appl. No.: 16/753,081

(22) PCT Filed: Sep. 25, 2018

(86) PCT No.: PCT/DE2018/100812
§ 371 (c)(1),
(2) Date: Aug. 6, 2020

(87) PCT Pub. No.: WO2019/068284
PCT Pub. Date: Apr. 11, 2019

(65) Prior Publication Data

US 2020/0373110 A1 Nov. 26, 2020

(30) Foreign Application Priority Data

Oct. 4, 2017 (DE) ..... 102017123021.1
Oct. 16, 2017 (DE) ..... 20 2017 106 260.0

(51) Int. Cl.
*H01H 39/00* (2006.01)
*H01H 85/00* (2006.01)
(Continued)

(52) U.S. Cl.
CPC ..... *H01H 39/006* (2013.01); *H01H 85/0039* (2013.01); *H01H 85/04* (2013.01); *H01H 85/38* (2013.01); *H01H 2039/008* (2013.01)

(58) Field of Classification Search
CPC ..... H01H 39/006; H01H 2039/008; H01H 85/0039; H01H 85/04; H01H 85/38
See application file for complete search history.

(56) References Cited

U.S. PATENT DOCUMENTS 4,490,707 A * 12/1984 O'Leary ..... H01H 39/006 200/61.08
6,556,119 B1 * 4/2003 Lell ..... H01H 39/006 337/157
(Continued)

FOREIGN PATENT DOCUMENTS

DE 4241922 A1 6/1993
DE 10296442 B4 6/2008
(Continued)

OTHER PUBLICATIONS

Fueyo, Ramirez M., Examiner, International Search Report, dated Nov. 19, 2018 in PCT Application No. PCT/DE2018/100812, Filed Sep. 25, 2018, Entitled: "Electrical Interrupter Switching Element Having Passive Interruption Tripping, in Particular for Interrupting High Currents at High Voltages".

*Primary Examiner* — Jacob R Crum
(74) *Attorney, Agent, or Firm* — Perry + Currier, Inc.

(57) ABSTRACT

An example interruption switch includes a casing surrounding a contact unit, defining a current path through the switch, which has two connection contacts, a separation region and a sabot. A current supplied to the contact unit may be interrupted via the one of the connection contacts and discharged via the other connection contact. At least one chamber in the switch, delimited by the separation region, is substantially filled with a vaporizable medium in contact with the separation region. The separation region is separable into at least two parts through the supplied current when a threshold amperage is exceeded. An electric arc forming between the two parts at least partially vaporizes the vaporizable medium, and a gas pressure to which the sabot is exposed forms. The sabot moves, in the casing, from a starting to an end position, achieving an insulation spacing between the connection contacts.

14 Claims, 10 Drawing Sheets

(51) Int. Cl.
*H01H 85/04* (2006.01)
*H01H 85/38* (2006.01)

(56) References Cited

U.S. PATENT DOCUMENTS

| | | | | |
|---|---|---|---|---|
| 9,911,560 | B2 * | 3/2018 | Lell | H01H 39/006 |
| 2006/0027120 | A1 * | 2/2006 | Smith | F42B 3/006<br>102/202.12 |
| 2013/0056344 | A1 * | 3/2013 | Borg | H01H 39/00<br>200/81 R |
| 2017/0213676 | A1 * | 7/2017 | Lell | H01H 39/006 |
| 2019/0122842 | A1 * | 4/2019 | Masumoto | F42B 3/006 |

FOREIGN PATENT DOCUMENTS

| | | | |
|---|---|---|---|
| DE | 102014107853 | A1 | 7/2014 |
| DE | 202016106931 | U1 | 12/2016 |

* cited by examiner

ELECTRICAL INTERRUPTER SWITCHING ELEMENT HAVING PASSIVE INTERRUPTION TRIPPING, IN PARTICULAR FOR INTERRUPTING HIGH CURRENTS AT HIGH VOLTAGES

The invention relates to an electrical interruption switch, in particular for interrupting high currents at high voltages.

Such switches are used for example in power plant and motor vehicle technology, and also in general mechanical and electrical engineering in electric switchboards of machines and plants, as well as within the framework of electromobility in electric and hybrid vehicles, but also in electrically operated helicopters and aircraft, for the defined and fast separation of high-current electric circuits in case of an emergency. It is required of such a switch that its tripping and interruption function must still be reliably guaranteed even without maintenance after up to 20 years. Furthermore, such a switch must not give rise to any additional potential danger due to hot gas, particles, ejected fragments or leaking plasma.

One possible area of application in motor vehicle technology is the defined, irreversible separation of the on-board wiring from the car battery or drive battery shortly after an accident or generally after a short-circuiting operation in the on-board wiring caused in another way, for example by a defective power train or a defective electric motor, in order to avoid ignition sources through sparks and plasma which occur for example if cable insulations have been abraded by body sheet metal penetrating during the accident or if loose cable ends press against one another or against sheet-metal parts and abrade. If gasoline leaks at the same time in the case of an accident, such ignition sources can ignite inflammable gasoline-air mixtures which accumulate under the engine hood, for example.

Further areas of application are the electrical separation of an assembly from the on-board electrical system in the event of a short circuit in the assembly concerned, for example in an independent electric heating system or in an electric brake, as well as the emergency shutoff of a lithium battery, such as are used today in electric and hybrid vehicles, as well as in aircraft. These batteries, with a small overall installed size, have a high terminal voltage of up to 1200 V with extremely low internal resistance. Both of these can potentially result in a short-circuit current of up to 5000 A, in some cases and briefly even up to 30 kA, without the source voltage dropping significantly, which even after a few seconds can lead to the battery igniting or exploding. The interruption switch presented here is also highly suitable for the emergency shutoff of individual solar cell modules or entire solar cell arrays should it be necessary, because it can be designed triggerable or remote-controllable. Furthermore, it can also be designed such that, in addition or instead, it trips passively, thus it can also simultaneously take on the function of a conventional safety fuse.

All use cases mentioned here as a rule involve shutting off direct current, which, unlike alternating current, has no zero crossing. This means that an electric arc, once formed in or on the switch, is not extinguished by itself, but rather remains stable and vaporizes all the materials in its reach here due to its extremely high temperature of several 1000° C., and also produces highly toxic gaseous substances in addition to its extreme thermal action and emitted radiation energy.

It is therefore disproportionately more difficult to interrupt high-voltage direct currents than to interrupt or shut off high-voltage alternating currents, and even more difficult the higher the lead inductance and the lower the effective lead resistance at the moment of the separation operation of the electric circuit.

Pyrotechnic fuses that are triggered actively for tripping are known in the state of the art. For example, an interrupter is known which comprises a metal casing which is connected, at two terminal regions spaced apart from each other, in each case to one end of a conductor that is to be protected. The current path runs via the casing. A pyrotechnic element which is formed by an explosive charge is provided in the casing. The explosive charge can be activated by an electric igniter which comprises an ignition element which is vaporized by a supply current. The casing is filled with an insulating liquid. The axially extended casing has a circumferential groove, along which the casing tears if the explosive charge is ignited. The casing is broken into two parts that are electrically isolated from each other, with the result that the electric circuit concerned is separated. The plasma forming when an electric circuit with very high amperage is separated is extinguished by the atomized insulating liquid in the case of this interrupter. In the case of a motor vehicle, the tripping can be effected by the signal of a shock sensor, for example.

Self-tripping for separating the electric circuit if the conductor to be protected is overloaded is not provided in the case of this known device because the entire sheath would have to be heated up to the tripping temperature and then a detonative reaction would not be reliably achieved. This is because it is difficult to ignite an explosive, i.e. to cause it to react detonatively, simply by heating the sheath.

A further disadvantage of this known device is the problem of authorization for devices which have assemblies filled with explosives or even detonators and have outward effects. For this reason, such devices have to date not been used commercially. They are used only very rarely in research institutes for special experiments. This is also due to the very low handling safety and the extremely high potential danger that can only be limited with great difficulty.

Furthermore, in many cases there is a demand for a self-tripping function of such a switch or of a fuse device, for example in order, without additional outlay for overload sensors, to protect a cable against overload or in the event of a failure of the tripping sensor system or trip circuit. It would thus be advantageous if a corresponding switch also had the function of a conventional high-current fuse in the form of a safety fuse, which anyone can handle safely, such as is the case with conventional safety fuses.

Such high-current safety fuses have the disadvantage of a shutoff time that varies within a large range after the threshold amperage of the fuse has been reached. A cable protected in this way can therefore only be utilized to a very small proportion, e.g. 30%, of its current-carrying capacity, as otherwise a cable fire, for example, can occur in the event of an overload.

The most severe disadvantage of safety fuses, however, is the situation where they form a conductive channel internally around the fuse element when very small excess currents are shut off, with the result that although the fuse element melts, the current is nevertheless not shut off thereafter because the current now flows via the conductive channel here.

Furthermore, emergency circuit breakers for electric circuits are known which make both self-tripping and triggerable tripping possible. For this, for example, an electrical conductor which has a pyrotechnic core is used. This can consist e.g. of a pyrotechnic material. The pyrotechnic core can on the one hand be ignited by the heating of the electrical conductor if a permissible amperage (threshold amperage) is exceeded. On the other hand, it is provided to ignite the pyrotechnic core using a triggerable ignition device, for example in the form of a glow wire. However, producing a conductor with such a pyrotechnic core requires a considerable outlay. In addition, even in the case of such emergency circuit breakers, a reliable, fast separation of the conductor can be guaranteed only if a detonative explosive substance is used. In deflagrating substances, i.e. substances that do not react detonatively, such as thermite or nitrocellulose powder, the conductor merely bursts open and the remaining gas escapes without the conductor being completely separated. Complete separation is then if need be achieved by the melting-through of the conductor as a result of the current flowing via the fuse. However, at higher voltages, in particular even at switching voltages of more than 100 V, this would necessarily lead to ion generation and thus plasma formation in the fuse and would thus in all probability prevent the interruption of the electric circuit.

Furthermore, electrical connecting elements, in particular for connecting high currents, are known which can be formed to be activatable both actively, i.e. by means of a triggerable ignition device, and passively, i.e. via the amperage of the current to be shut off. Such a connecting element as a rule has a casing which can comprise a contact unit, wherein the contact unit has e.g. two connection contacts connected in a fixed manner to the casing or formed in one piece therewith for supplying and discharging an electrical current to be connected, and wherein the two connection contacts, e.g. in the initial state of the connecting element, are electrically conductively connected inside the casing. In the casing, an activatable material is provided which after the activation generates a gas pressure which is exerted on the contact unit, wherein the electrically conductive connection is separated by the exertion of the gas pressure. The contact unit can comprise a contact element which is movable relative to the fixed connection contacts by means of the exertion of the gas pressure generated and which, due to the exertion of the gas pressure generated, is moved in the direction of the axis of the contact unit from its starting position into an end position, in which the electrical connection via the contact unit is interrupted. These switching units are designed such that there is no movement whatsoever of parts towards the outside. In addition, in the case of an activation, no dangerous gases or fragments whatsoever escape to the outside.

However, it has transpired that such switching units have only limited suitability for shutting off very high direct currents at higher voltages, since due to the interruption of the separation region as a result of the separation of the electric circuit here an electric arc is always drawn, which cannot be prevented because of the energy that is stored in the lead inductance at the moment of separation in the magnetic field thereof and released in the electric circuit at the moment of separation. Attempts to use an extinguishing agent which, in the initial state before activation, surrounds the separation region have shown that the desired success, namely to prevent the formation of an electric arc or to reliably extinguish an already existing electric arc, is not achieved by this means alone.

In the case of known pyrotechnic drives, whether integrated into any device or as an independent device, the activatable material which is provided to generate the pressure or pressure surge (also referred to as shock wave in the following) is introduced into a combustion chamber. The volume of the combustion chamber is usually also the volume of the powder chamber and usually includes the volume which the pyrotechnic material requires to be stored in the assembly before it is triggered. However, if, depending on the volatility or burning rate of the pyrotechnic material, only a small quantity of the activatable material is required, or if as little activatable material as possible is to be contained in the assembly for reasons of the highest possible level of safety in the event of an accident, there is often the problem that the combustion chamber cannot be formed small enough, or that the activatable material, which is often present in solid form, for example compressed form, cannot be produced with the tolerance required in order to fill up the entire combustion chamber. The residual volume of the combustion chamber, which is not taken up by the activatable material, and the air present therein or the gas present therein limit in particular the steepness of the pressure increase, which is generated after the activation of the activatable material, additionally require energy that dwindles away in the actual operation of breaking open the so-called separation region and then the acceleration operation of the membrane or of the piston and also attenuate any type of shock wave that could have been used to break open the separation region in the case of minimal use of pyrotechnic material. The residual volume filled with air or a gas thus reduces the transmission of a rapid mechanical impulse to the drive element of the pyrotechnic drive device (also referred to as sabot in the following).

With regard to safety aspects, both the smallest possible mass of pyrotechnic material and at the same time the smallest possible void volume in the assembly are also desirable: any void volume can be depressed by the pyrotechnic reaction by the gaseous reaction products being formed here, thus an energy reservoir can be created after the ignition, which is discharged when, for example, the assembly has been overloaded just once and ruptures. The "high-pressure gas reservoir" thus created would then be discharged with a corresponding bang and parts being flung around—which cannot happen if there are no void volumes in the assembly or gas-filled volumes after the tripping of the assembly.

At the same time it is desirable to give the energy always being released at the moment of separation of the circuit and stored in the lead inductance at the moment of the separation operation the opportunity to act, i.e. to be able to be converted to other energy forms, in order to be able thus to "disappear" from the circuit.

The heating up and also partial vaporization of the vaporizable medium/extinguishing agent in the region of the electric arc forming, the chemical decomposition of the medium due to the electric arc—which is undesirable as a rule because electrically conductive substances or electrically conductive elements usually form again here, which do not allow the insulation resistance between the connection contacts to increase sufficiently after the separation—and the purely mechanical deformation of regions of the assembly, i.e. the deformation of the lead element in the so-called upsetting region, are suitable for this.

Furthermore, it is desirable, if possible, not to use any pyrotechnic material in such interruption switches, and nevertheless to make it possible to shut off the current flow.

Starting from this state of the art, the object of the invention is to create a pyrotechnic interruption switch, in particular for interrupting high currents at high voltages, in which the shutting off of high currents at high voltages is also guaranteed as reliably as possible by the avoidance or at least the effective attenuation of a current maintained by the energy contained in the magnetic field of the lead inductance at the moment of separation and by the collapsing of the field after separation. In addition, a switch is to be created which is largely non-hazardous in terms of safety and can be produced in a simple and cost-effective manner.

The invention achieves this object with interruption switch provided herein.

The interruption switch according to the invention, in particular for interrupting high currents at high voltages, has a casing, which surrounds a contact unit defining the current path through the interruption switch. The contact unit has a first and second connection contact, a separation region and a sabot. The contact unit is formed such that a current to be interrupted can be supplied to it via the first connection contact and can be discharged therefrom via the second connection contact, or vice versa. At least one chamber in the interruption switch, which is at least partially delimited by the separation region or the contact unit, is filled with a vaporizable medium/extinguishing agent, with the result that the separation region is in contact with the vaporizable medium/extinguishing agent. The interruption switch according to the invention is characterized in that the separation region, the sabot and the vaporizable medium/extinguishing agent are formed such that the separation region (the so-called contact unit) can be separated into at least two parts through the supplied current when a threshold amperage is exceeded (preferably can be melted or is melted), wherein an electric arc forming between the two parts of the separation region (heats and then) vaporizes the vaporizable medium/extinguishing agent, with the result that a gas pressure to which the sabot is exposed forms, wherein the sabot in the casing is moved in a movement direction from a starting position into an end position, wherein in the end position of the sabot an insulation spacing is achieved between the first and the second connection contact.

According to a design of the invention the interruption switch according to the invention preferably does not have any activatable means to separate the separation region or to move the sabot, i.e. the separation of the separation region is then here effected purely passively, without an active means, such as for example a detonative or deflagrating material. This is possible because an electric arc forming can vaporize the vaporizable medium/extinguishing agent and can thus increase the pressure on the sabot, just as a pyrotechnic material would also do after the activation thereof. The sabot is thereby moved in a direction in which the two separated parts of the separation region are moved further away from each other by simultaneously squeezing out the material in the so-called upsetting region of the contact unit. In this way, the actually undesired electric arc is simultaneously cooled, disrupted and ultimately extinguished due to the draining of the magnetic energy of the lead inductance, or it cannot continue to be maintained. Previously, it was always undesired to prevent the formation of the electric arc in such interruption switches. An activatable material was therefore always used to initially break open the contact unit and to rapidly move the separated parts of the separation region away from each other. However, it has surprisingly been established in the case of the present invention that an activatable medium can even be dispensed with entirely, with a triggering of the interruption switch nevertheless taking place, if a vaporizable medium or a vaporizable extinguishing agent is used and if the separation region is designed accordingly. In other words, the formation of an electric arc is ultimately used to switch the interruption switch in order then—effectively after the work is done—to extinguish the then already much weaker electric arc again.

According to a design of the invention, the separation region can be formed of a metal which can form an alloy with a soft solder material. The effect that an alloy has a much lower melting point compared with the metal in the non-alloy state is exploited here. In this way, from a certain threshold amperage a temperature can be achieved at which, in combination with the duration of exposure to this temperature, the alloy formation commences, with the effect that the melting temperature of the separation region at this point is dramatically lowered. By lowering the melting temperature the separation of the separation region and the formation of the electric arc between the two ends of the separation region occur much earlier; the assembly can thus already switch passively at lower currents or also simply only separate the electric circuit earlier/more quickly after the action of an excess current. The soft solder material is preferably arranged on the surface of the metal of the separation region. Here, in the case of a hollow-cylindrical or hollow-prismatic design of the separation region, the soft solder material can be applied circumferentially. Furthermore—independently of the design of the separation region—the soft solder material can also be applied to one or more delimited surface(s). The soft solder material can however also coat the entire separation region. The soft solder material can be applied thermally, by pressing it on or by other suitable methods. The base material of the separation region can consist, for example, of copper. In this case, for example, tin can be used as soft solder material. However, all combinations of materials from which an alloy can be formed are also conceivable for the base material and the soft solder material. Two or more different soft solder materials can also be used in combination. Upon reaching the threshold amperage the solder atoms can penetrate into the base material and produce an intercrystalline region there, in which the melting temperature is lowered.

For example, during the heating up of the contact unit by the current flowing through it the melting temperature of a copper used for the contact unit can hereby be lowered from 1075° C. to only 175° C. This effect is known; it is thus already introduced in some safety fuses—and can also be used successfully in the case of the protective element described here.

The vaporizable medium/extinguishing agent can be a liquid medium, a powder or a solid. The vaporizable medium preferably passes entirely or partially into a gaseous state when the boiling or vaporization temperature is reached. It is also preferred for the vaporizable medium to have insulating properties, in order that the electric arc can be extinguished after the two separated parts of the separation region have been moved away from each other sufficiently and there is thereafter a sufficient insulation from a current flow, which is then undesired, between the separated contacts. An oil, for example silicone oil, or a silane, for example hexasilane, with as little as possible carbon atom content is preferred as liquid medium. For example, boric acid, boron oxides and/or salts of boric acid, in each case with or without preconditioning inside or outside the interruption switch according to the invention at increased temperatures, can be used as powder or solid.

In particular in order to improve the insulation strength or insulation properties between the two connection contacts after the separation, in a design of the invention a substance for capturing or oxidizing elemental carbon or other compounds, which possibly form through the direct contact of the electric arc with the extinguishing agent or with surrounding materials—also a portion of the material of the sabot, of the internal insulation, of the casing and also of the contact unit itself vaporize here—can be added or admixed. This has the advantage that the materials that have decomposed into electrically conductive substances or elements through the contact with the electric arc, such as for example the elemental carbon from the decomposition of a silicone oil itself that is used as extinguishing agent (=electrically conductive), are captured or oxidized to form electrically non-conductive or only extremely weakly conductive substances, in order to prevent the electrical conductivity of the extinguishing agent from being increased. For example, highly dispersed silica (HDS) can be added to capture elemental carbon. Perchlorates or better permanganates, such as $KMnO_4$, $KClO_4$, $KClO_3$ or zirconium potassium perchlorate (ZPP), can for example be used as substances for oxidizing elemental carbon. At the same time, all named substances have the property of reacting exothermically during the oxidation. In this way the distance between the two separated parts of the separation region can be increased more quickly, which leads to faster extinguishment of the electric arc. In other words, in a design of the invention a substance which during the formation of the electric arc reacts exothermically or releases additional energy for the additional heating and vaporization of the vaporizable medium/extinguishing agent can be added to the vaporizable medium/extinguishing agent. Thermites, for example, can also be added to the vaporizable medium here.

The terms "vaporizable medium", "extinguishing agent" and "extinguishing medium" are used synonymously in the present application.

In a design of the invention, a substance which increases the capacity of the vaporizable medium to absorb mechanical energy can be added to the vaporizable medium. As the magnetic energy of the circuit inductance must be converted in a dissipative manner, the energy which can penetrate into the liquid can in this way be converted effectively in a dissipative manner.

In a further design of the invention, it is also possible to add to the vaporizable medium one or more substances which increase the insulation strength between the two separated parts of the separation region in that they can absorb very large amounts of energy dissipatively when they are heated, melted and vaporized, without simultaneously releasing electrically conductive substances—as in the case of silicone oil. Here, for example, all conceivable types of rock, cements, aluminas, chamotte, ground or sintered silicates or corundums, preferably dispersed in powder form (rock flour) in the extinguishing medium, can be inserted or mixed in.

In a design of the invention, the separation region is preferably designed such that it has predetermined breaking points, for example in the form of narrowings, notches, holes or cross-sectional jumps. In this way the separation region can be designed such that in the case of a desired threshold amperage it heats up more quickly at the predetermined breaking points, at the same time the release of particles or fragments is minimized and then it is separated into at least two parts, with the result that the at least intermediately desired electric arc can form and consequently the interruption switch separates and shuts off the electric circuit more quickly and cleanly, i.e. with the release of the fewest possible and, if this is unavoidable, then at least the smallest possible particles.

In a design of the invention, it is preferred for the separation region to be formed hollow-cylindrical or hollow-prismatic, with the result that it at least partially surrounds a chamber ("the one chamber" in the following), i.e. the wall of the separation region at least partially delimits the one chamber.

According to a design of the invention, the separation region can separate the one chamber from a further chamber. This further chamber surrounds the separation region, preferably in an annular manner. If not only the one chamber, but also the space of the further chamber is filled with the vaporizable medium, the separation operation of the separation region takes place entirely in the vaporizable medium, with the result that an electric arc forming during the initial breaking open is directly connected to the vaporizable medium. This furthermore has the advantage that the electric arc can then be extinguished relatively quickly, and further discharge phenomena can easily be prevented. According to this design of the invention, during the separation of the separation region the one chamber can thus be connected to the further chamber. Here, it is preferred for both the one chamber and the further chamber to be filled with the vaporizable medium, or an extinguishing agent. However, the further chamber can also contain a medium which is powdered or is present in the form of an oil-wet powder. Here, the powder can be made of all conceivable types of rock (preferably as rock flour), cements, chamottes, aluminas, ground or sintered silicates or corundums. If it is an oil-wet powder, silicone oil is preferably used as wetting agent here. The silicone oil can also be successfully thickened with highly dispersed silica (HDS). Furthermore, the further chamber can also contain red phosphorus, either in powder form, or as an additive in the extinguishing medium. The further chamber can also be filled with cured silicone.

The length of the hollow cylinder in the separation region/the length of the switch separator preferably lies in the range of from 3 mm to 15 mm, more preferably in the range of from 5 mm to 10 mm and even more preferably in the range of from 6 mm to 8 mm. For special cases, however, separator widths of 1 mm are also advantageous, in particular if switching is to be effected particularly quickly or only in the case of extremely high overload currents. The wall thickness of the hollow-cylindrical separation region/the material thickness of the switch separator can be up to 1500 μm; the range from 400 μm to 700 μm is preferred here, wherein a partial region can always be thinner here or/and provided with a circumferential groove, in order to allow the heating of the extinguishing medium resting against it and the breaking open of the separation region material to occur more quickly.

According to a design of the invention, the hollow-cylindrical separation region can thus have one or more grooves, which are preferably circumferential grooves. The separation region can have a circumferential groove, for example, on the outside and in the center relative to its width, in order to ensure that, when the separation region is severed and the electric arc is formed, the two separated ends effectively roll up/bead well. It is thus ensured that no larger material shreds are formed. At the same time both contact ends formed are reinforced by the beading and the electric arc also forming here is thus prevented from vaporizing too much material of the relatively thin separator of the separation region and thus being further fueled.

The hollow-cylindrical separation region can, however, also have two circumferential grooves, preferably one in proximity to the geometrical origin of the separation region (e.g. at the end of the radius of the cross-sectional jump) and one in proximity to the end of the separation region (e.g. at the end of the radius of the cross-sectional jump). It is thereby achieved that two smaller electric arcs form, which can be cooled more easily because of their smaller size. Significantly less conductive material is thereby produced inside the interruption switch due to the electric arc, so that the insulation behavior is dramatically improved after functioning or separation operation and the electric arc is additionally weakened, thus combustion material is effectively removed therefrom.

In the case of several grooves in the separation region, when separated, several electric arcs will also form, i.e. at each groove one electric arc, at which, similarly to conventional safety fuses, a partial quantity of the outwardly applied high source voltage falls, thus each individual electric arc is supplied with less voltage and thus energy than would be the case with a single electric arc or a single separation point.

The hollow-cylindrical separation region can furthermore also have further circumferential grooves. If the width of the grooves is chosen to be sufficiently narrow relative to the length of the hollow-cylindrical separation region in the extension direction of the hollow cylinder, the loop-in resistance is not increased by these grooves, but rather they only have a mechanical effect, as desired.

According to a design of the invention, the hollow-cylindrical separation region can also have a circumferential thickening, e.g. in the form of a small lump. Such a small lump acts as a heat sink and as a reinforcement. The hollow-cylindrical separation region preferably has two circumferential grooves on both sides of the small lump. In such an arrangement it is ensured that the separation region is separated at the grooves, and two smaller electric arcs form, which can be cooled or extinguished more easily.

According to a design of the invention, a gap which is connected to the volume surrounding the yet further chamber can be provided between the casing or its internal insulation and the sabot. The sabot can be designed such that the gap in the starting position of the sabot connects the further chamber to the volume surrounding the yet further chamber. However, the sabot can also be designed such that the further chamber is not connected to the volume surrounding the yet further chamber in the initial state of the sabot. If the interruption switch switches, the sabot is moved from the initial state in the direction of the end state. At the latest as soon as the sabot is moved, a connection between the further chamber and the volume surrounding the yet further chamber is created by the gap. The presence of the gap results in the following effects/advantages: once the separation region of the contact unit tears open and gas pressure acts on the sabot, a gas flow forms through the gap around the sabot in the direction of the upsetting region. Because the pressure ratio between the one chamber and the volume surrounding the yet further chamber lies far beyond the critical pressure ratio of the gas mixture in the one chamber determined by the isentropic exponent, a perpendicular compression shock which effectively delimits the gas flow via the gap opening and causes the sabot to be depressed and accelerated as previously will immediately form in the gap. Nevertheless, this flow directly against the casing or the internal insulation causes an additional flow in the one chamber perpendicular to the axis of the contact unit, and thus an intense disruption of the electric arc formed.

As second positive effect, the washing or removal of larger and smaller particles out of or from the one chamber into the volume surrounding the yet further chamber via the connecting gap may be mentioned. These particles are thus flushed out of the one chamber into the volume surrounding the yet further chamber. In this way, parts broken out of the separation region can be removed, which could otherwise shorten the distance between the two separated ends of the separation region. The gap around the sabot thus acts like a vacuum cleaner, without the sabot itself being driven measurably less.

A further advantage of the presence of the gap is the fact that the electric arc energy can additionally work effectively due to this forced gas flow. The energy stored in the outer lead inductance at the moment of the separation of the separation region thus can be converted not only by the heating up and vaporization of the extinguishing medium/vaporizable medium and by the deformation of the upsetting region, but also by the flow work.

A further advantage is that the vaporizable medium located in the one chamber and strongly altered by the action of the electric arc, i.e. made electrically conductive as a rule, is now largely pushed out of the chamber into the volume surrounding the yet further chamber and thus no longer loads the separating distance between the two separated parts of the separation region. An extremely good insulation resistance between these is brought about thereby.

A further advantage of the presence of the named gap is that the gas pressure building up over the upsetting region even stabilizes the upsetting of the upsetting region.

The geometry of the named gap depends strongly on the dimensions of the interruption switch according to the invention, but also on whether more flow work must be done or the electric arc must be cooled or disrupted more. As a result, the geometry of the gap is to be determined by means of tests in every case, for every intended use and every design of the assembly. This applies in particular to the design of the inlet geometry, here e.g. the flushing effect can be strengthened by a slightly funnel-shaped design of the outer diameter of the sabot.

According to a design of the invention, the casing can have an internal insulation, which is preferably likewise designed tubular, on its inner surface. However, it can also be preferred for this internal insulation not to be present. If this internal insulation is not present, it is preferred for the casing to be made of metal. This has the advantage over a plastic casing that in particular gaseous, conductive gases (Cu, K and Fe vapor) condense on the casing, which is cold relative to the hot waste gases or reaction gases which can form due to the vaporization of the extinguishing medium or of the material of the separation region caused by the electric arc. If the casing is made for example of plastic, a metal layer, preferably Cu, brass or Ag, can be applied thereto on the inside or arranged next to the surface of the casing, or designed in the form of a metal tube in the case of the cylindrical design of the casing. Such a metal layer can be present with or without internal insulation of the casing in embodiments. If an internal insulation is present, it is located between the casing and the metal layer or the metal tube. The advantage of the presence of a metal is that in this way energy can be taken away from the electric arc. Also in the case of the presence of such a metal layer or such a metal tube, the presence of the above-named gap is advantageous, as such a metal, which is preferably made of Cu, brass or Ag, stretches more strongly than a casing made of steel. The gap here makes space for this stretching.

According to a design of the invention, the contact unit can have an upsetting region. The upsetting region can be designed such that it surrounds a yet further chamber. The upsetting region can be designed such that it is upset during the separation operation of the separation region. It is preferred for the material of the upsetting region to be an easily deformable, optionally also soft-annealed material, in order to improve the folding behavior of the upsetting region.

According to a design of the invention, the yet further chamber of the upsetting region can also be completely filled with the vaporizable medium. Through the movement of the sabot and/or the upsetting operation of the upsetting region, the volume of the yet further chamber is reduced such that the vaporizable medium is injected through at least one channel between the at least two parts of the separation region. In this case it is preferred for the yet further chamber to be connected to the one chamber via at least one hole (channel). The vaporizable medium can thereby be pushed out of the yet further chamber via the channel into the one chamber during the upsetting operation and thus more effectively suppresses or cools the electric arc possibly still present at the separation region. At the same time the extinguishing agent, which may have already partially decomposed in the one chamber, is diluted by the medium newly flowing in, and thus the insulating properties of the "stressed" extinguishing agent are likewise improved. In a design of the invention, thermites can be added to the extinguishing agent in the further chamber. In a design of the invention, thermites are added only to the extinguishing agent in the further chamber. Alternatively, the further chamber can also be filled with thermites in powder form.

According to an embodiment of the invention, the upsetting region can be designed with regard to the material and the geometry such that the wall of the upsetting region is folded, preferably folded in a meandering fashion, as a result of the upsetting movement.

The at least one channel can be formed nozzle-like. In particular, the channel can be aligned such that it is aimed in its extension direction at the fixed separated end of the separation region.

Like the separation region, the upsetting region can also be formed hollow-cylindrical and preferably annular in cross section. The vaporizable medium can thus be introduced inside the hollow cylinder. An annular cross section promotes a uniform folding, viewed over the circumference, of the hollow cylinder wall during the upsetting operation.

In an embodiment of the invention, the upsetting region can have at least one perforation, which makes a connection between the yet further chamber and a volume surrounding the yet further chamber possible. In this way additional vaporizable medium or extinguishing agent can be made available during the upsetting operation, and the volume, increasing due to the movement of the sabot, of the one and of the further chamber can be refilled with vaporizable medium/extinguishing agent. More extinguishing agent is thereby available for the switching electric arc and additional possible work is available for the magnetic energy stored in the circuit inductance at the moment of separation of the separation region, with the result that the material of the upsetting region can be better reshaped. Because more extinguishing agent is available the electric arc forming in the separation region can be better cooled or disrupted. Furthermore, a gas space can also be prevented from forming in the chamber volume around the separation region. The quantity of gas in the depressed space can also be kept as small as possible after the tripping, and thus the explosion risk associated with a highly depressed gas space can be minimized. Furthermore, in this way the vaporizable medium partially converted by the electric arc can be diluted by the newly injected vaporizable medium/extinguishing agent. Better insulation values are achieved thereby. Through the filling of the yet further chamber, the extinguishing time is also lengthened by delaying the upsetting operation. It is thereby achieved that the current shutoff also still functions in the case of larger time constants of circuit inductance and circuit resistance: the upsetting time determines the time in which the vaporizable medium/extinguishing agent is injected into the one chamber and the further chamber and thus particularly effectively cools, disrupts and through material conversion or vaporization allows the electric arc present there to work. If the time constant of the load resistance and the circuit inductance is greater than the time which is available during or through the upsetting, the interruption switch can no longer cool the current then still flowing after the end of the separation operation, and thus the electric arc still present then. The internal pressure due to the vaporizing medium thereby increases, and the undesired destruction or explosion of the interruption switch can result. The magnetic energy stored in the circuit inductance at the time of the shutting off or the tripping of the interruption switch must be converted into other forms of energy. According to the invention the following possibilities are available for this conversion:

heating and ultimately the vaporization of the extinguishing medium or the at least partial chemical conversion thereof when it is in contact with the electric arc, upsetting of the material of the contact element in the upsetting region, heating of the extinguishing medium by flow resistances during the upsetting of the upsetting region (through appropriate design of the overflow surfaces the upsetting time here can be adapted to the maximum time constant, or the time constant actually present, of circuit inductance and load resistance according to the equation tau=L*R).

The introduction of a perforation in the upsetting region has the advantage that by way of its size the flow resistance of the liquid overflowing here during the compression of the upsetting region is high enough or can be set to be optimal for the switching operation. The vaporizable medium/extinguishing agent can thereby better absorb the magnetic energy stored in the circuit inductance at the time of the separation or convert it into other forms of energy.

In a design of the invention, concentric copper bands or, in the sabot, copper segments or copper discs, can be inserted on the internal insulation, i.e. the inner insulated side of the casing. In this way the electric arc can easily and quickly release energy thereto via heat conduction and can temporarily store heat/energy here. The electric arc forming is thereby extremely intensively cooled on contact or energy is quickly withdrawn from the electric arc or the circuit inductance. This effect can be increased if the electric arc is forced through an external magnetic field in the direction of these copper bands or copper segments. The strong permanent magnets available today, like coils which the current to be connected itself flows through in series, are suitable for generating the strong magnetic fields that are necessary here—but here again with the disadvantage that they increase the lead inductance, which is actually undesired.

In a design of the invention, it is preferred for the one chamber, the further chamber and the yet further chamber to be filled with a vaporizable medium/extinguishing agent, wherein the vaporizable medium/extinguishing agent can be the same or different in the different chambers. It is preferred for the vaporizable medium/extinguishing agent in the further chamber to be different from the vaporizable medium in the one chamber and the yet further chamber. By "different" is also meant vaporizable media/extinguishing agents the base material of which is the same, but which can contain one or more identical or different substances in different concentrations. A medium with a higher viscosity than in the other two chambers is preferably used in the further chamber. If silicone oil is used as base material, with which a substance for capturing or oxidizing elemental carbon is mixed, it is preferred for the silicone oil in the further chamber to have a higher concentration of said substance than the silicone oil in the one and the yet further chamber. It is preferred here for the concentration to be at least 5 times higher, more preferably at least 10 times higher. Highly dispersed silica (HDS) is preferably used as such a substance. In a strongly preferred embodiment, the concentration of HDS in the further chamber lies in a range from 30 g/l to 70 g/l silica, more strongly 45 g/l to 55 g/l silica.

In a design of the invention, thermites can be added to the vaporizable medium in the one and in the yet further chamber as well as the channel connecting these chambers. In a design of the invention, thermites are inserted only in the above-named chambers (including channel) and not in the further chamber.

In a design of the invention it may also be preferred for only the one chamber and the yet further chamber as well as the connecting channel to be filled with the vaporizable medium. It may be preferred here for the further chamber to contain no vaporizable medium/extinguishing agent.

The contact unit can have a straight longitudinal axis, along which the sabot is displaceable. The separation region can then be provided bordering the sabot and lying in the longitudinal axis. Separation region and upsetting region here are preferably arranged in each case on opposite sides of the sabot and bordering it. The at least one channel—if present—can also lie in the longitudinal axis. The contact unit is preferably constructed such that it has a flange between the upsetting region and the separation region, in which the sabot can engage and by the movement of which the upsetting region can be upset.

The contact unit can consist of an electrically conductive material, preferably copper or aluminum or brass, wherein copper or aluminum is preferred.

However, switches are also conceivable in which the sabot of the contact unit can move in a more or less curved casing, with the result that switches can be manufactured in which the two current connections are at an angle of between 1° and 300°, preferably at 30°, 45°, 90°, 120° or 180°. Thus, in the case of a casing curved by 180°, after tripping and the breaking open of the separation region, the sabot would move in a semi-circle in the casing, with the result that both current connections come to lie on the same side.

In a design of the invention, the interruption switch can have one or more heat sinks. In the further chamber, heat sinks can be deposited for example on the sabot, and/or on the internal insulation of the casing. Cu, Ag, brass or steel come into consideration as a material for heat sinks. Here it is preferred for the heat sinks to be coated with Ni in order to prevent corrosion and thus poorer heat transfer. Heat sinks can absorb energy and, in the process, cool the interruption switch or the electric arc.

In a design of the invention, the contact element can have a first connection contact region containing the first connection contact and a second connection contact region containing the second connection contact, which are arranged in each case on opposite sides of the separation region. The first connection contact region can be arranged lying in the longitudinal axis bordering the upsetting region, and the second connection contact region can be arranged lying in the longitudinal axis bordering the separation region. It is hereby achieved that during the tripping two separation points form in the assembly, and thus two electric arcs form, which effectively share the task: thus only half the source voltage of the electric circuit to be separated is applied to each electric arc, therefore the energy to be converted dissipatively per separation point here also corresponds to only half the energy that would have to be converted in the case of only one separation point.

In a design of the invention, the first connection contact region can be designed hollow-cylindrical and preferably annular in cross section. In this way, in the case of the electrical interruption switch of the invention, a third connection contact or a sensor can be present which, while the sabot is being moved in the direction of the end position, is mechanically and/or electrically actuated. In this way the third connection contact or sensor can serve as detection means for an effected tripping of the interruption switch. The third connection contact can be electrically connected to the first connection contact. In this way voltages can also be reduced via the third connection contact.

The third connection contact (also called center electrode) is preferably formed as a wire, rod or spring, preferably as a copper or brass wire/rod or copper spring, which preferably extends in the internal space formed by the first connection contact region along the longitudinal direction of the contact unit, and preferably reaches from the outer region of the interruption switch into the chamber surrounded by the upsetting region. In this way it can be guaranteed that, during the upsetting operation of the upsetting region, the upset upsetting region comes into contact with the rod, wire or spring of the third connection contact, whereby the first and the third connection contact can be connected to one another conductively. The use of a spring has the advantage that it works against the upsetting operation to a lesser extent than a stiff wire or rod. If the third connection contact is formed as a rod or wire, it is therefore preferred for its end projecting into the interruption switch to be split into at least two parts.

This so-called center electrode can be used to short-circuit, outside the separation point, the magnetic energy stored after separation of the connecting element in the inductance of the load circuit at the moment of switching and thus to relieve the separation point in energy terms.

However, this center electrode can also be used merely to give the superordinate system feedback about an assembly tripped once or a connecting element opened once.

All designs of the interruption switch of the invention which have a third connection contact can be used by energy stored in the consumer (e.g. electric motor) with respect to ground. The interruption switch is incorporated via the first and the second connection contact into an electric circuit, which has a current source and any desired consumer. Preferably, the first connection contact is connected to the any desired consumer and the second connection contact is connected to the current source. If the electric circuit is interrupted by the switching of the interruption switch, the stored energy in the consumer can result in the formation of an electric arc between the separated parts of the separation region of the interruption switch. If the third connection contact is connected to the other side of the any desired consumer than the first connection contact, the energy stored in the consumer can be discharged to ground in the case of switching of the interruption switch according to the invention through the connection forming between the first and the third connection contact. In this way the electric arc forming can be effectively "starved out", because hereafter the energy is short-circuited outside the separation point. This means that the third connection contact or the so-called center electrode is used as a short-circuit electrode in this case.

Alternatively, the interruption switch according to the invention with a third connection contact can also be used as a sensor for an interruption switch that has already been tripped. For this, only the resistance between the second connection contact and the third connection contact needs to be measured. If the resistance is about zero ohms, then the interruption switch has already been tripped. However, other sensing device designs (sensors) can also be used here in order e.g. to facilitate an isolated feedback signal.

The interruption switch according to the invention can be designed cylindrical or coaxial in its shape. In order to secure such an interruption switch, so-called connection mountings are preferably used which preferably fix the interruption switch to the connection contacts.

In a further design of the invention, the interruption switch according to the invention can, to secure it to one or both connection contacts, have straight or angled tabs molded to it (by welding, by eddy current or by explosive forming), with the result that the assembly can be screwed directly into a superordinate system, or fitted or screwed onto a flat surface or board. In this case, additional connection mountings are no longer necessary for this.

In a design of the invention, the interruption switch according to the invention can have a rectangular cross section, with the result that the assembly can be easily mounted on outer electrical conductors or flat surfaces.

In a design of the invention, the casing of the interruption switch according to the invention preferably consists of plastic. Another electrically conductive metal layer, which is thin in relation to the wall thickness of the casing, can be present on the outside of the casing, as shielding against external electric fields and for the damping of the interfering electric fields forming during the separation (EMC). Metals that can preferably be used for this are Al, Cu, Ag, or alloys thereof.

In a design of the invention, the casing of the interruption switch according to the invention preferably consists of plastic. Another magnetically conductive metal layer, which is thin in relation to the wall thickness of the casing, can be present on the outside of the casing, as shielding against external magnetic fields (EMC), which inhibits external magnetic fields and likewise attenuates the interfering magnetic fields forming during the separation of the electric circuit by the interruption switch outwardly. Metals that can preferably be used for this are soft iron, mu-metal or metals forming a hard magnet.

To create an interruption switch which implements a series of multiple interruptions, the contact unit can have at least two partial contact units, which each have an upsetting region, a separation region and a sabot. The partial contact units can then each be formed such that, when an electric arc is formed, each sabot is exposed to the gas pressure generated by vaporization of the vaporizable medium in such a way that the respective sabot in the casing is moved in a movement direction from a starting position into an end position and in the process the associated upsetting region is plastically deformed, wherein the respective separation region is completely separated, and in the end position of the respective sabot an insulation spacing is achieved between the separated ends of the respective separation region.

Such a series of multiple interruptions has the advantage that, during a simultaneously effected interruption operation, in each case only a proportional voltage is applied between the ends that are to be separated of the separation regions, and thus the energy converted in a partial electric arc is in each case correspondingly reduced, and thus the partial electric arcs can be extinguished more effectively and more quickly.

In a preferred embodiment, two partial contact units are provided, and the contact unit and the casing are formed mirror-symmetrical relative to a center plane, wherein the separation regions and the sabots are preferably provided outside the upsetting regions arranged in between them. In addition to the serial separation, the advantage results here that the mechanical movements proceed in opposite directions and thus at least largely compensate for one another outwards.

Outwardly, the interruption switch according to the invention is reactionless. No exhaust gases, no light and no plasma escape, the tripping noise is to be perceived only as a soft click, and the two electrical connections of the interruption switch can be firmly fixed, since no movement of one or the other connection is necessary for the function of the switch.

The casing itself can be provided as a tube with caps screwed in or crimped in on both sides, preferably comprising a pot-like part into which a cap is screwed together with the entire contact unit. The casing can also be formed in one piece if the material thereof can be easily reshaped, for example by crimping or bending. The casing can also be composed of several parts to form a one-piece casing, for example by adhesive bonding or welding of the individual parts.

An integral arrangement of one or more contact units in a superordinate collective casing or in a superordinate commercial assembly is also possible.

The interruption switches according to the invention can be covered with a so-called heat shrinkable tubing, which insulates externally and fits over the casing of the interruption switch. The heat shrinkable tubing can preferably consist of a well-insulating, preferably transparent, material, for example polyolefin. Thus, the casing/the assembly is protected against corrosion and the casing, which is metallic here in the examples, is simultaneously prevented from short-circuiting nearby live parts. Labels or inscriptions can thus also be durably protected and also durably protected against aggressive media.

Of course, the casing can also consist of an electrically non-conductive material, for example ceramic, POM, PA6 or ABS.

In a design of the invention, the interruption switch can also have a magnet. Such a magnet is to be designed such that the electric arc is diverted. By diverting the electric arc, the undesired current flow between the two separated ends of the separation region can at least be reduced. Such a magnet can be arranged outside or inside the casing of the interruption switch. For this either permanent magnets or coils can be used. If a magnet is arranged outside the casing, a permanent magnet is preferred. If the magnet is a coil, it is preferably arranged in series with the current flow through the interruption switch. The latter would have the advantage that with increasing excess current the magnetic field would also become greater and would divert the electric arc more strongly. However, such a magnet also has the advantage that the effect of a U-shaped conductor loop could be compensated for in the case of the connection of the interruption switch. If the interruption switch is part of such a U-shaped conductor loop, the electric arc forming in the interruption switch would then be pushed away from the current loop by its own field. In order not to destroy the internal insulation of the interruption switch, such a magnet can be used against this pushing away. However, such a coil or coil arrangement would also increase the circuit inductance, which is in principle undesired.

In a further design of the invention, the interruption switch according to the invention can be connected in an arrangement in parallel with a safety fuse. In other words, the present invention also relates to a device in which an interruption switch according to the invention is connected in an arrangement in parallel with one or more safety fuses. In such a circuit the interruption switch only has the task of shutting off the partial current by itself in the case of the then only very low switching voltages here (here only the voltage which, through the current flow via the fuse(s) connected in parallel therewith, falls due to the internal resistance thereof is applied to the interruption switch), thus a corresponding excess current then flows through the safety fuse and shuts it off. The interruption switch then has to hold only the applied source voltage after the switching of the safety fuse(s), which is however not a problem, because here the switching does not have to be carried out while current is flowing. With such an arrangement, the switching capacity of the arrangement can be dramatically increased, in particular also towards medium voltage uses up to 10 kV and currents up to 50 kADC and above, and can then in particular also be used for lead protection with very high circuit inductances.

In a further design of the invention, the interruption switch according to the invention can be connected in an arrangement in series with one or two safety fuses. In other words, the present invention also relates to a device in which an interruption switch according to the invention is connected in an arrangement in series with one or two safety fuses. In these embodiments two safety fuses are preferably used. The two safety fuses here are preferably connected before and after the interruption switch, i.e. connected to the negative and positive terminal of the interruption switch, in order to be able to protect both terminals, because a short circuit can occur both in the negative and in the positive circuit loop. In such an arrangement, the safety fuses have the task of forming a series resistor for the interruption switch in the case of a strong overload and thus above all of limiting the voltage applied to the separation region by the voltage that is falling down to the electric arc voltage in the fuses. In this way the shutting off of the interruption switch can be guaranteed more reliably.

In a further design of the invention, the interruption switch according to the invention can be connected in an arrangement in series with one or two relays. In other words, the present invention also relates to a device in which an interruption switch according to the invention is connected in an arrangement in series with one or two relays. In these embodiments two relays are preferably used. In this way the switching capacity of the interruption switch can be increased. The relays have, in addition to their function as usual operating switches, the task of limiting the excess current in the overload range to such an extent that the current can be reliably shut off by the interruption switch. The relays preferably have contacts that lift off electrodynamically in the case of overload (levitating contacts). Through the lifting off of the contacts in the case of overload, the increase in the voltage measured at the moment of separation of the separation region is lowered to just above the operating voltage and thus, in a similar way to the described safety fuses in series with the interruption switch, the applied or effective voltage on the assembly at the moment of the separation operation is reduced. Without such contacts the voltage would increase to three times the operating voltage through the discharging of the inductance on the load side. A powerful electric arc would thereby be ignited, which would be much more difficult to extinguish.

In a further design, wire clamps or wire angle brackets are electrically and mechanically connected to one or both contacts of the interruption switch such that the interruption switch can thus easily be screwed onto or placed on a flat plate, and contact mountings, which were to be used previously, no longer have to be used. This is particularly important in aviation and in the automotive sector, because substantial weight savings can thus be achieved.

In a further design of the interruption switch, the latter is formed as part of a slide with or without a hand grip, which can thus be easily introduced into an existing electric circuit or removed again. Simple safety measures can also be integrated here, for example for shutting off the electric circuit when the slide is pulled through a closed circuit, which for example allows a contactor to drop out during pulling before the final separation of the switch from the electric circuit when it is removed, in order thus to reliably enforce the currentless state thereof when the assembly is removed.

The internal insulation can thus be formed as a hard-anodized layer in a casing made of aluminum or as a ceramic or AV coating of a steel casing. Most O-rings can be injection-molded into or onto the plastic parts, then also no longer have to be fitted individually here and can then also no longer be forgotten. All non-movable electrically insulating parts, i.e. all except the casing and the sabot, can also be insert-molded around the contact unit. Thus, the number of individual parts and of assembly steps, as well as consequently the production costs of the assembly, can be dramatically reduced.

Further aspects of the invention are also described herein.

The invention is explained in more detail below with reference to the embodiments represented in the drawings. All features which are described in relation to a particular figure can also be transferred to the interruption switches of the other figures, provided this is technically possible:

Figure 1:
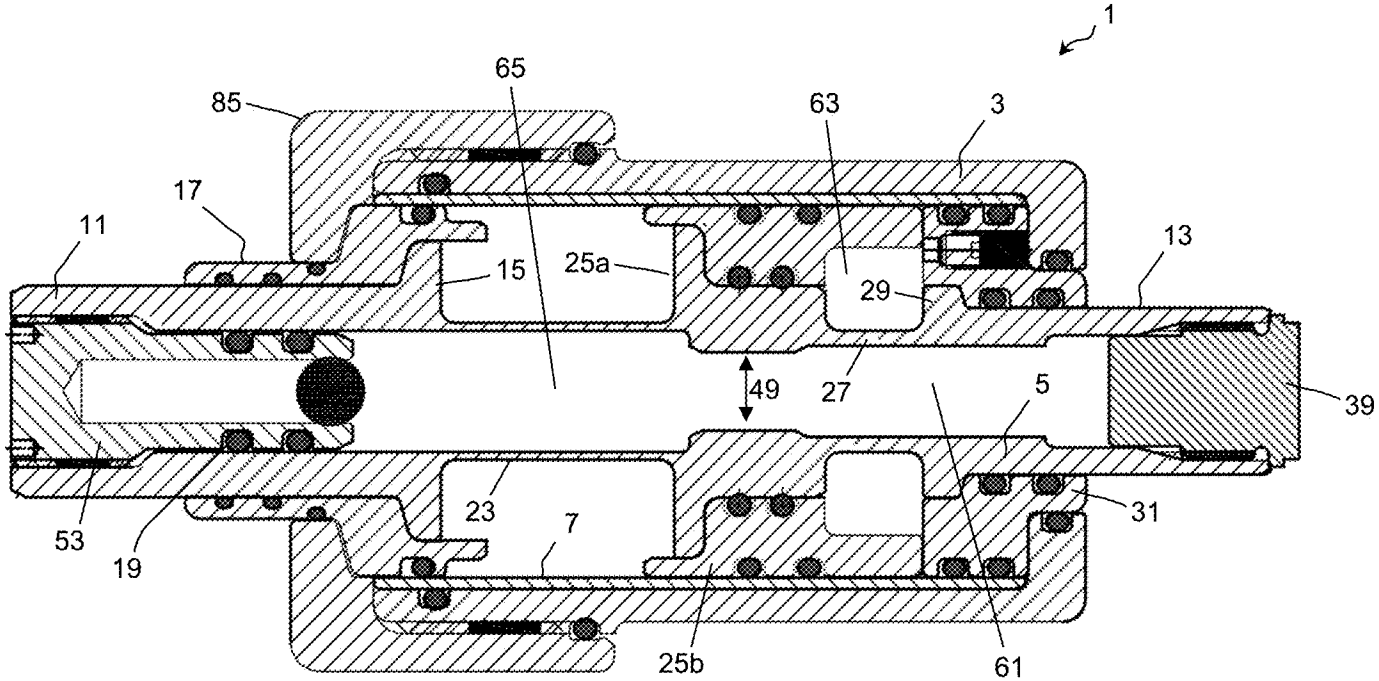
FIG. 1 shows a longitudinal section through an interruption switch according to the invention in the initial state (sabot in starting position).

The embodiment of an interruption switch 1 according to the invention represented in FIG. 1 comprises a casing 3 in which a contact unit 5, also called connecting element, is arranged. The casing 3 is formed such that it withstands a gas pressure, generated inside the casing, which is generated by vaporization of a vaporizable medium under the influence of an electric arc, without the risk of damage or even bursting. The casing 3 can in particular consist of a suitable metal, preferably steel. In this case, an insulation layer 7 which consists of a suitable insulating material, for example a plastic, can be provided on the inner wall of the casing 3. Polyoxymethylene (POM) can be used for example as plastic for this purpose. In the case of higher voltages, flashovers or an electrical contact between the contact unit 5, which of course consists of a conductive metal, for example of copper, and the casing 3 are hereby avoided, in particular during and after the tripping of the interruption switch 1. However, electrically non-conductive materials such as ceramic, POM, PA6 or ABS are also possible here as casing material, which, however, as a rule have to be suitably reinforced, for example by ribs. In these cases, the wall thickness of the casing 3 will also usually turn out to be thicker than in the case of a metallic casing.

The protective cap 85 shown in FIG. 1 is only present when the casing 3 is closed by a locking nut (not shown). When the casing 3 is depressed after tripping the casing tube would expand in diameter here (the flow of forces is interrupted here), and the screw thread would disengage here, and the assembly would thus burst. The protective cap 85 prevents this expansion and is omitted if the casing 3 is in one piece or is welded on both sides to the washer (not shown) then present here.

In the embodiment example represented, the contact unit 5 extends beyond both ends of the interruption switch 1, is formed predominantly as a tube and comprises a first and a second connection contact 11/13, a separation region 27, a region of a channel 49, an upsetting region 23 and two flanges 15/25*a*, through which the upsetting region can be depressed by the sabot 25*b*. In the embodiment example represented, the contact unit 5 has the first connection contact 11 with a larger diameter and the second connection contact 13 with a smaller diameter. Adjoining the first connection contact 11 is the flange 15 extending radially outwards, which is braced on an annular insulator element 17, which consists of an insulating material, for example a plastic, in such a way that the contact unit cannot be moved out of the casing 3 in the axial direction. The plastic used for this can be polyoxymethylene, ABS or nylon, but ceramics are also possible and in special cases are useful. For this purpose, the insulator element 17 has an annular shoulder, on which the flange 15 is braced. In addition, the insulator element 17 insulates the casing 3 from the contact unit 5. The annular insulator element 17, in an axially outer region, has an internal diameter which substantially corresponds to the external diameter of the contact unit 5 in the region of the first connection contact 11. As a result, a sealing action is achieved, which is strengthened by an additional annular sealing element 19, for example an O-ring. The insulator element 17 can also be connected to the contact unit 5 via a press fit, or injection-molded onto it.

The casing 3 is designed on the end face represented on the left in FIG. 1 during the assembly of the interruption switch 1 in such a way that a part of the casing extending radially inwards fixes the insulator element 17. If the casing consists of plastic, the insulator element 17 can also be omitted.

The contact unit 5 has the upsetting region 23 adjoining the flange 15 in the axis of the contact unit 5. In the upsetting region 23, which has a predetermined axial extent, the wall thickness of the contact unit 5 is chosen and adapted to the material in such a way that, when the interruption switch 1 is tripped, as a consequence of a plastic deformation of the contact unit 5 in the upsetting region 23, the upsetting region 23 is shortened in the axial direction by a predetermined distance.

In the axial direction of the contact unit 5, the flange 25*a*, on which a sabot 25*b* is seated in the embodiment example represented, adjoins the upsetting region 23. The sabot 25*b*, which in the embodiment example represented consists of an insulating material, for example a suitable plastic, surrounds the contact unit 5 with its part 25*b* in such a way that an insulating region of the sabot 25*b* engages between the outer circumference of the flange 25*a* and the inner wall of the casing 3. If a pressure acts on the surface of the sabot 25*b*, a force is generated which compresses the upsetting region 23 of the contact unit 5 via the flange 25*a*. This force is chosen such that, during the tripping operation of the interruption switch 1, upsetting of the upsetting region 23 occurs, wherein the sabot 25*b* is moved out of its starting position (status prior to the tripping of the interruption switch 1) into an end position (after the completion of the switching operation).

As can be seen from FIG. 1, the sabot part 25*b* can be chosen such that its external diameter substantially corresponds to the internal diameter of the casing 3, with the result that an axial guidance of the flange 25*a* and thus also an axially guided upsetting movement is achieved during the switching operation.

After the pressing operation, the lugs of the insulator element 17 and of the sabot 25*b* lying near the casing 3 engage over each other completely, with the result that the upsetting region 23, which has been pushed together in a meandering fashion after the tripping and the upsetting operation, is completely surrounded by electrically insulating materials.

Adjoining the sabot 25*b* or the flange 25*a* of the contact unit 5 is the separation region 27, which in turn is preferably adjacent to a flange 29 of the contact unit 5 in the axial direction. The second connection contact 13 then adjoins the flange 29. The flange 29 in turn serves to fix the contact unit 5 securely in the casing 3 in the axial direction. This purpose is served by an annular region of the casing 3 (not provided with a reference number) extending radially inwards and a closure 31, which is provided between a corresponding stop face of the flange 29, the inner wall of the end-face annular region of the casing 3 and the axial inner wall of the casing 3, and which annularly surrounds the second connection contact 13 of the contact unit 5. The flange 29 can engage in the closure 31 in the axial direction. As an alternative to this it can also be placed on the closure 31 in the axial direction. The closure 31 can consist of metal, in particular steel.

If the closure 31 does not consist of a metal or a ceramic but rather of a plastic, a metal disc with a diameter which is greater than the right-hand opening of the casing must be introduced after the flange 29 in order, in the event of fire—in the event of fire the plastic parts are no longer there of course—to prevent parts from escaping from the casing 3.

If the casing 3 and the closure 31 are made of steel, it is possible to join these parts to each other by electron-beam or ultrasonic welding. Joining by laser beam is also possible.

In the embodiment example represented, during the assembly of the interruption switch 1, the sabot 25*b* is pushed onto the contact unit 5 from the side of the connection contact 13 and must therefore be dimensioned such that its internal diameter is greater than or equal to the external diameter of the flange 29.

The closure 31 is designed as an annular component, which has an external diameter which substantially corresponds to the internal diameter of the casing 3, and an internal diameter which substantially corresponds to the external diameter of the flange 29 or the second connection contact 13.

For complete sealing and fixing of the contact unit 5, the interior of the closure element 39 can be potted, in particular with a suitable epoxy resin. The closure element 39 can be provided with a screw thread in order that it can be screwed into the second connection contact 13 of the contact unit 5 but later, if the assembly is implemented in series, for cost reasons it is merely pushed into the second connection contact 13, preferably formed as a tubular part, and then crimped in, clinched or curled.

The closure 31 can consist of a metal, in particular steel. This has the advantage of the connection of potential between the casing 3 and the second connection contact 13. In this way "the casing knows where it belongs with respect to the potential". The latter is important in high-voltage circuits in order not to obtain any undesired electric arcs with parts having no connection of potential. In addition, the casing 3 shields the inner region of the interruption switch 1 from electromagnetic radiation, e.g. a radar beam.

The separation region 27 is dimensioned such that it tears open completely due to the generated gas pressure, with the result that the pressure can propagate into the further chamber 63 designed as a surrounding annular space. To facilitate the tearing open, the wall of the contact unit can also have one or more openings or holes (not shown) in the separation region 27.

The electrical resistance and thus also the thermal behavior of the separation region 27 can be influenced by the provision of openings in the wall of the separation region 27 (in conjunction, of course, with the wall thickness of the separation region and the dimensioning of the radii at the transitions of the separation region, which substantially determine the heat outflow from the separation region and its rupturing behavior). As a result, the current-time integral at which the interruption switch 1 trips passively can be defined or set. The inertia can also be influenced by such a dimensioning.

In the case of an activation of the interruption switch 1 by means of the passive activation, a gas pressure is thus generated on the side of the sabot 25*b* facing away from the upsetting region 23, as a result of which the sabot 25*b* is exposed to a corresponding axial force. This force plastically deforms the contact unit 5 in the upsetting region 23, while the sabot is moved in the direction of the first connection contact 11.

In the embodiment shown in FIG. 1, there is located in the chamber 61 and in the further chamber 63 a vaporizable medium (not shown), which is vaporized when the separation region 27 tears open by the electric arc forming, and the vapor pressure forming in the process exposes the sabot to pressure. The vaporizable medium is preferably at the same time an extinguishing material, with the result that, after the interruption switch has been switched, it can attenuate and cool or extinguish the electric arc between the separated ends of the separation region 27.

On the side of the first connection contact 11 the interruption switch 1 has a closure element 53, which outwardly delimits the one yet further chamber 65 of the contact unit 5.

The channel 49 of the contact unit 5, which extends underneath the sabot 25*b*, in particular in the flange 25*a*, preferably centrally in the axial direction, connects the chamber 61 to a yet further chamber 65, which is delimited by the upsetting region 23 and the closure element 53. In the embodiment example represented, the contact unit 5 is thus formed further as a continuous switch tube. Although not shown in FIG. 1, it is preferred for the chamber 61, the channel 49, the yet further chamber 65 and the further chamber 63 to be filled with a vaporizable medium/extinguishing agent. The channel 49 ensures that, when the interruption switch 1 is tripped and during the associated movement of the sabot 25*b* from the starting position into the end position, the increasing volume in the region of the combustion chamber 61 and the further chamber 63 is also refilled with vaporizable medium/extinguishing agent. Through the movement of the sabot 25*b* from the starting position into the end position, vaporizable medium/extinguishing agent in the yet further chamber 65 is compressed and injected through the channel 49 in the direction of the region of the chamber 61 and here directly onto the separation point 27. In this way it is ensured that the electric arc between the separated parts of the separation region 27 is extinguished in a controlled manner.

Figure 2:
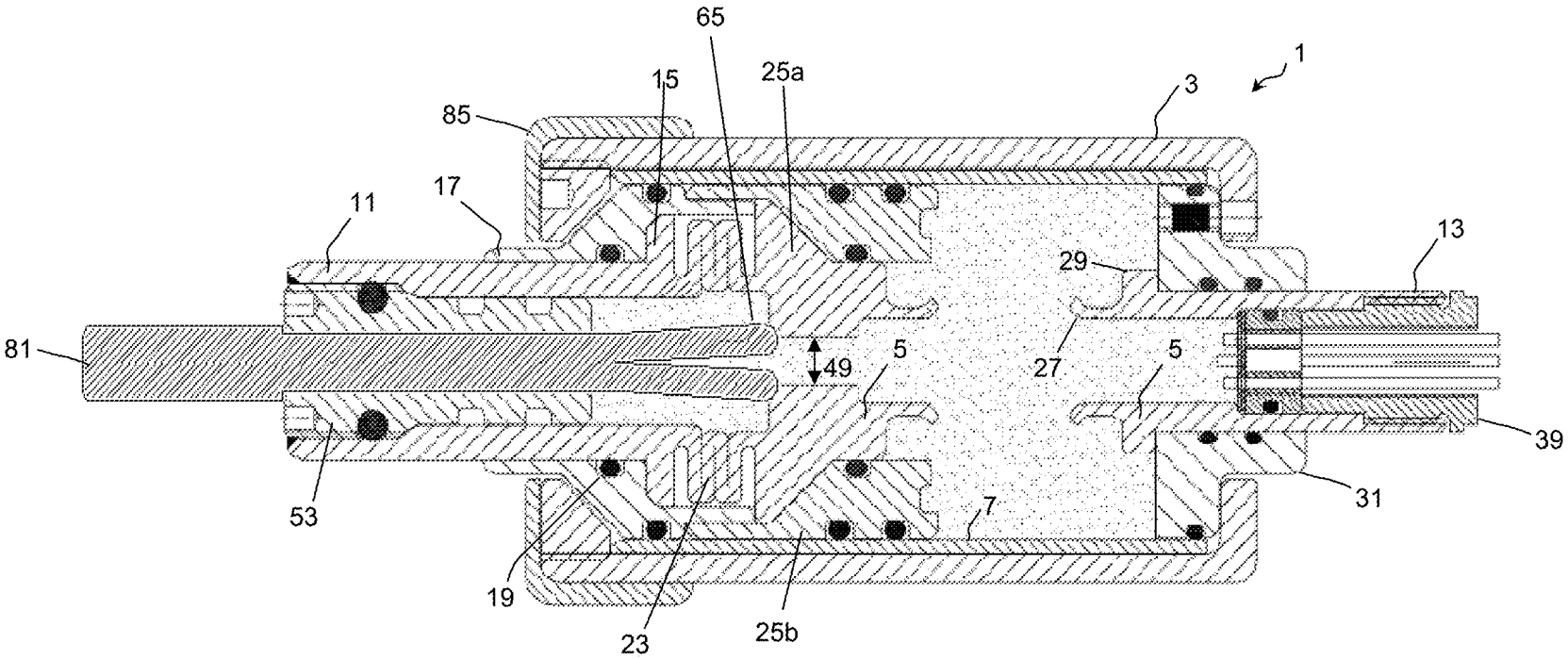
FIG. 2 shows a longitudinal section through an interruption switch according to the invention in the end state (sabot in end position).

FIG. 2 shows an interruption switch 1 according to the invention according to FIG. 1 in the end state, i.e. in the tripped state, in which the separation region 27 has been separated, the sabot 25*b* is in the end position and the upsetting region 23 is present upset. Purely by way of example, the interruption switch 1 in FIG. 2 differs from that of FIG. 1 only in that it has a third connection contact 81, as described further above.

Figure 3:
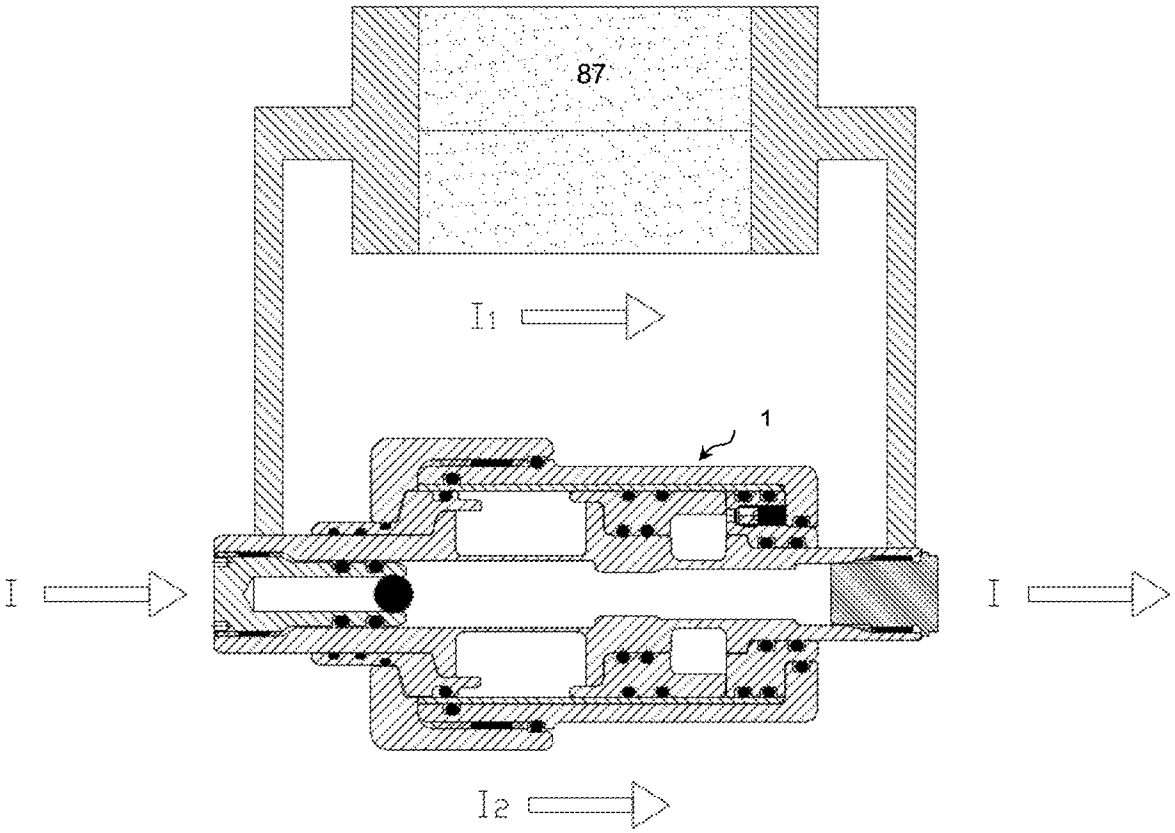
FIG. 3 shows an arrangement in which an interruption switch according to the invention is connected in parallel with a safety fuse.

FIG. 3 shows an arrangement in which an interruption switch 1 according to the invention is connected in parallel with a safety fuse 87, as described further above. The current I divides as a result of the parallel connection into partial currents $I_1$ and $I_2$, wherein $I_1$ is the current of the safety fuse 87 and $I_2$ is the current of the interruption switch 1.

Figure 4:
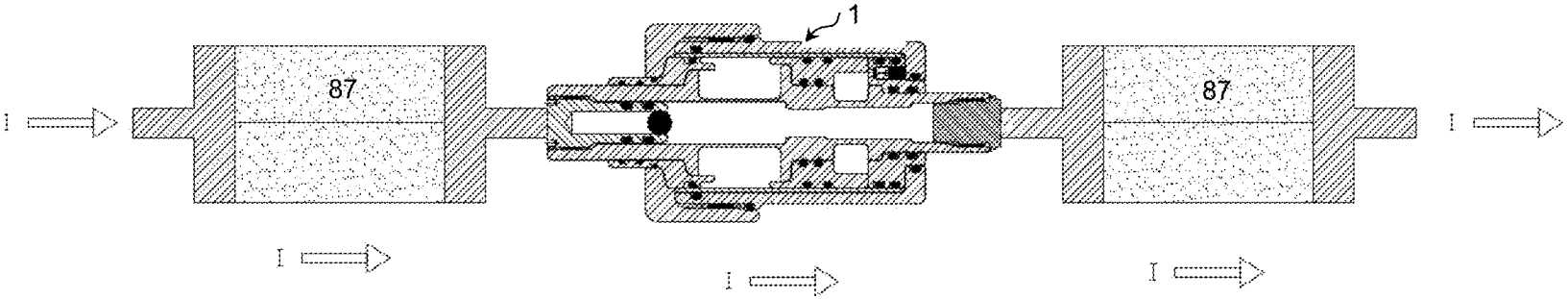
FIG. 4 shows an arrangement in which an interruption switch according to the invention is connected in series with two safety fuses.

FIG. 4 shows by way of example an arrangement in which an interruption switch 1 according to the invention is connected in series with two safety fuses 87, to which the current I is applied. The two safety fuses 87 here are connected before and after the interruption switch 1, i.e. connected to the negative and positive terminals of the interruption switch 1. In such an arrangement the safety fuses have the task mentioned further above.

Figure 5A:
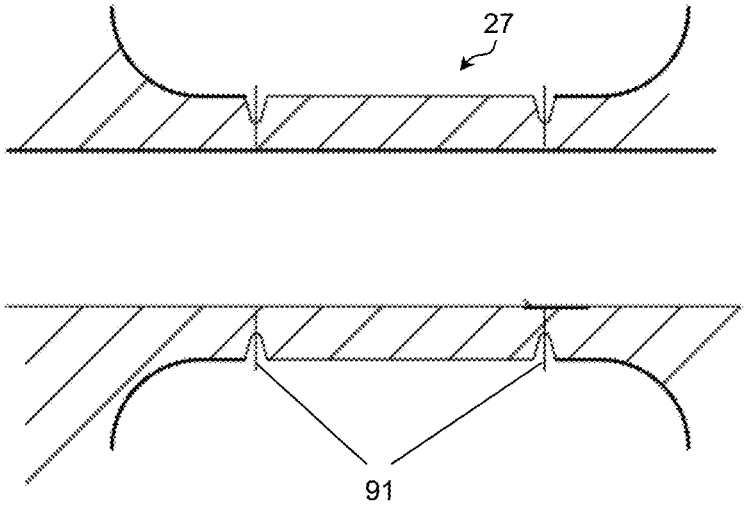
FIG. 5A shows a separation region of an interruption switch according to the invention with two circumferential grooves.
Figure 5B:
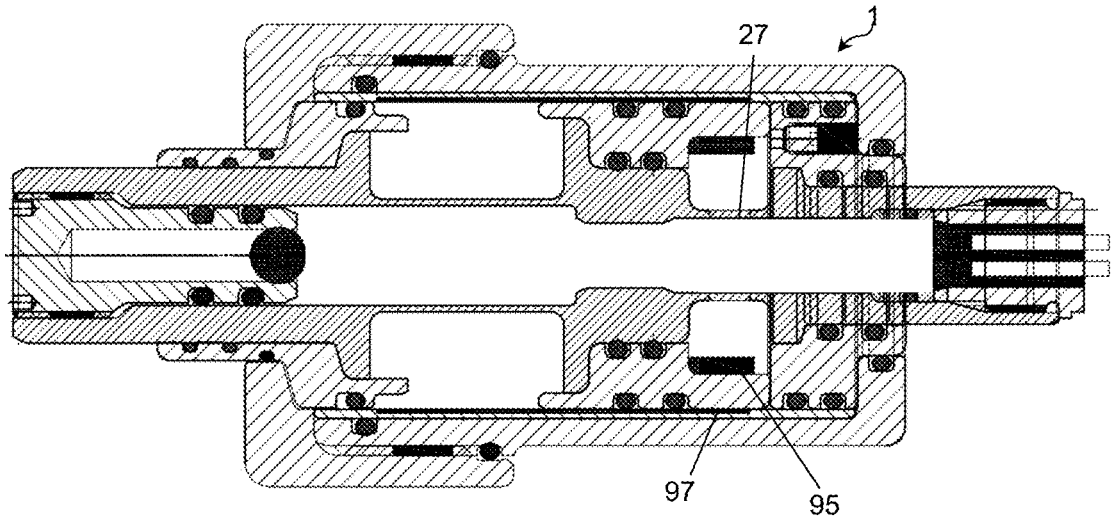
FIG. 5B shows an interruption switch according to the invention with a separation region according to FIG. 5A.

FIG. 5A shows a hollow-cylindrical separation region 27 with two circumferential grooves 91—as described generally further above. FIG. 5B shows an interruption switch 1 according to the invention with a separation region 27—as shown in FIG. 5A.

Figure 6A:
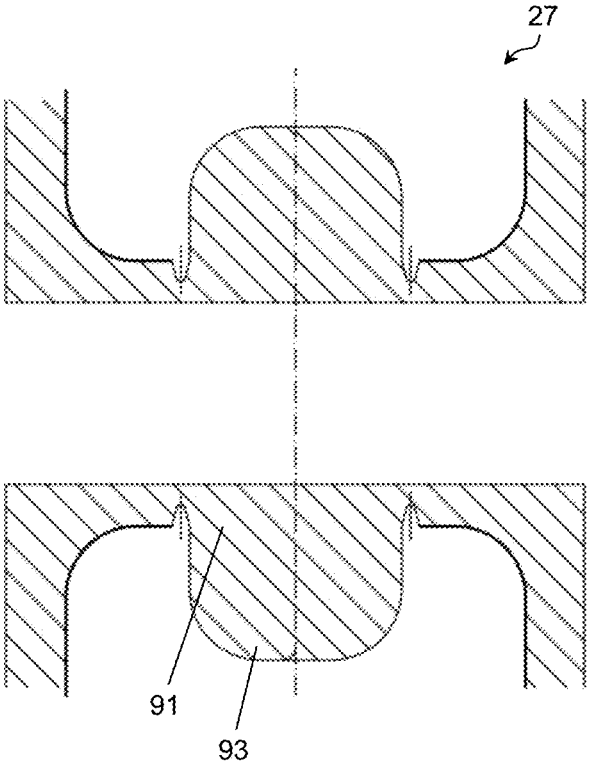
FIG. 6A shows a separation region of an interruption switch according to the invention with a circumferential thickening (small lump).
Figure 6B:
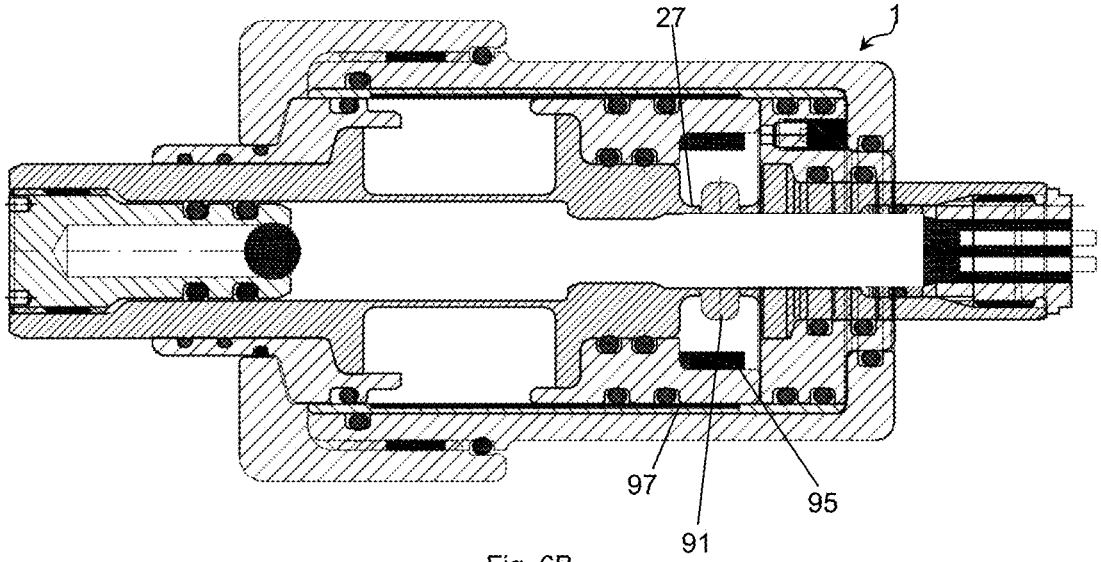
FIG. 6B shows an interruption switch according to the invention with a separation region according to FIG. 6A.

FIG. 6A shows a hollow-cylindrical separation region 27 with a circumferential thickening (small lump) 93—as described generally further above. Furthermore, the separation region 27 shown in FIG. 6A has a circumferential groove 91 in each case to the left and right of the circumferential thickening 93. FIG. 6B shows an interruption switch 1 according to the invention with a separation region 27—as shown in FIG. 6A.

The interruption switch 1 in FIGS. 5B and 6B also has a heat sink 1 95 and a heat sink 2 97—as are described generally further above. The heat sinks are only represented by way of example in these figures and can be combined with any further embodiment of the invention. The heat sink 1 95 is preferably mounted in the further chamber on the sabot, and the heat sink 2 97 is mounted on the internal insulation of the casing 3. The heat sink 1 95 can be formed circumferentially, i.e. tubular, or lamellar. The heat sink 2 97 preferably runs circumferentially on the inside of the casing or the internal insulation thereof, i.e. is formed tubular.

Figure 7:
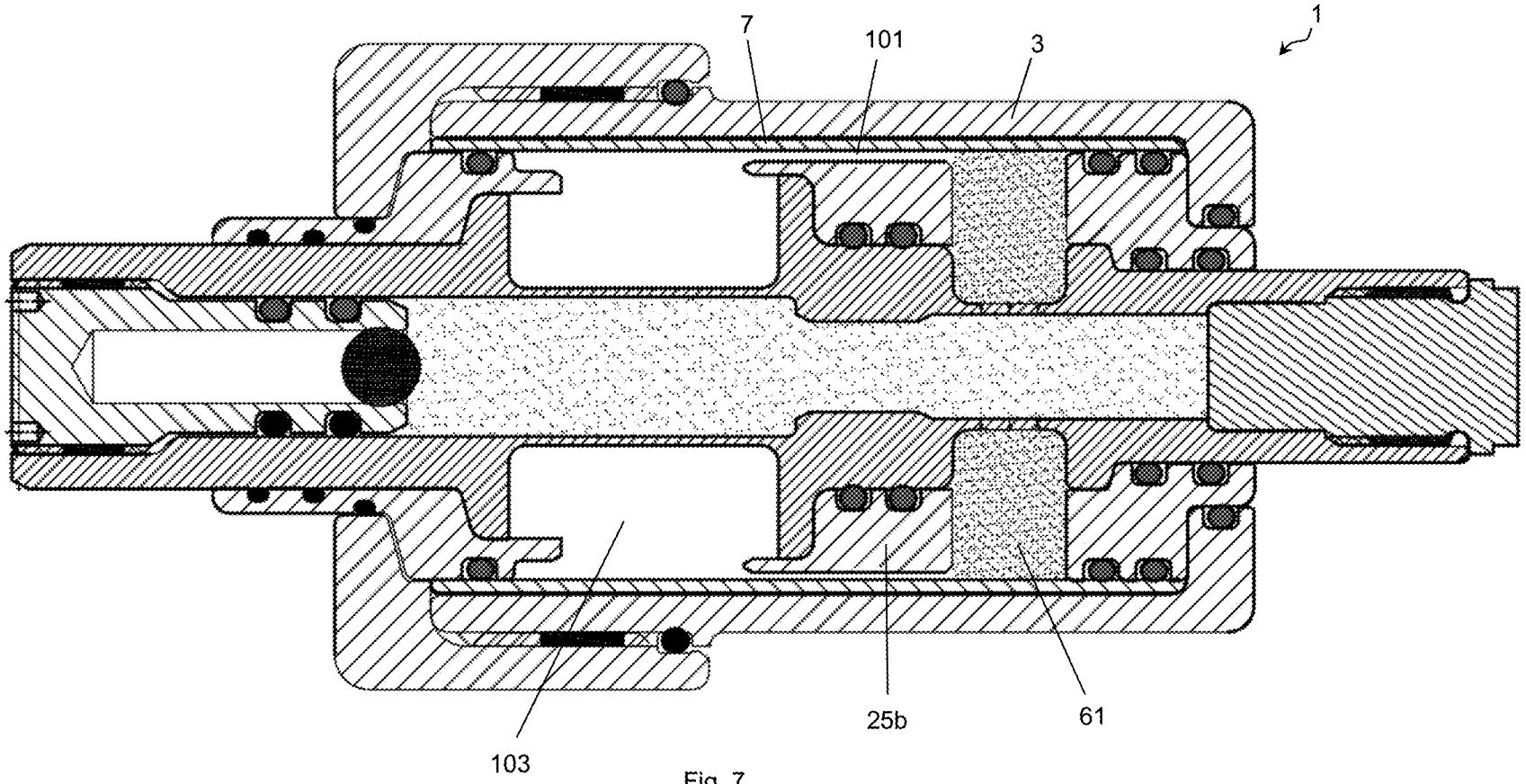
FIG. 7 shows an interruption switch according to the invention with a gap between the casing and the sabot, wherein the gap connects the one chamber to the volume surrounding the yet further chamber.
Figure 8:
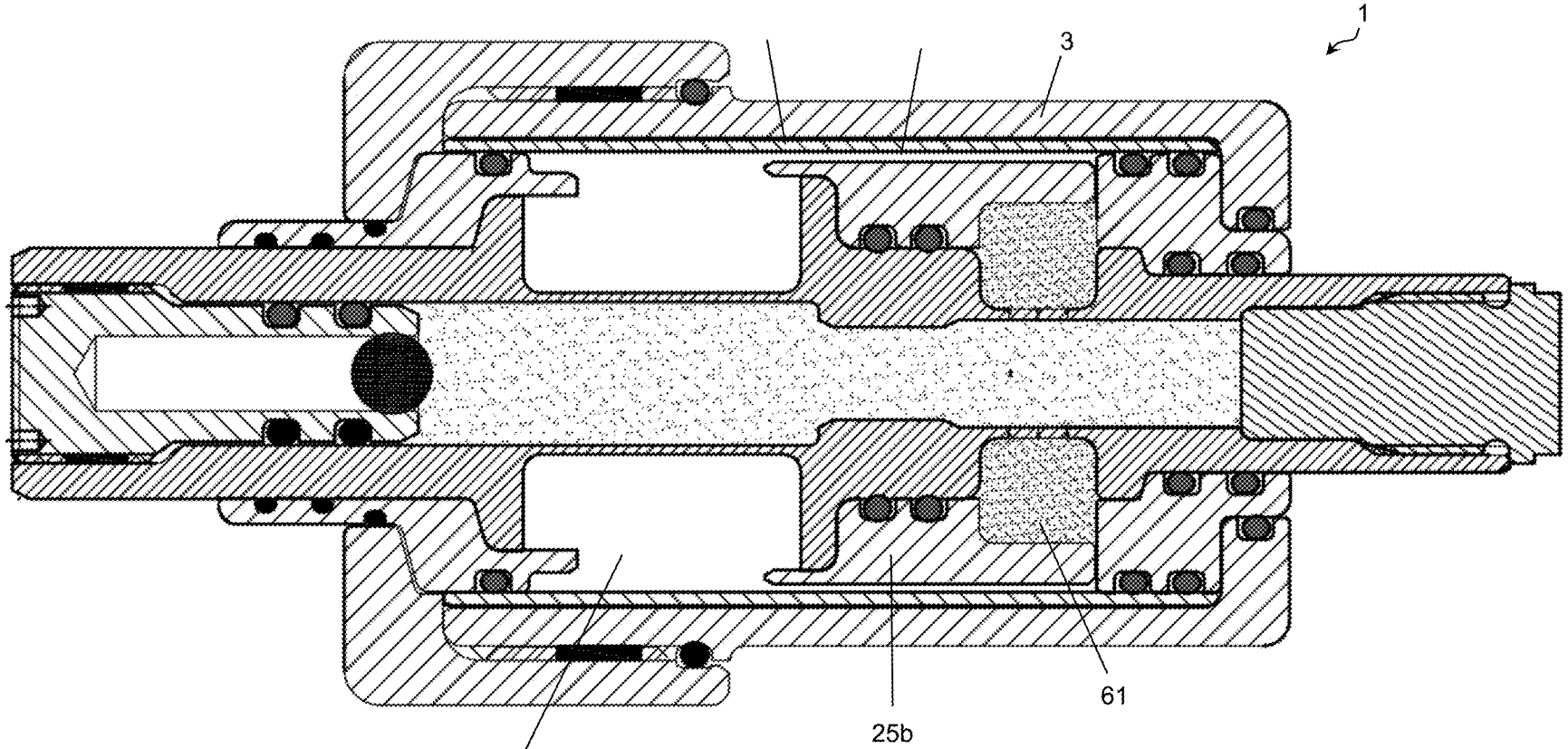
FIG. 8 shows an interruption switch according to the invention with a gap between the casing and the sabot, wherein the sabot is designed such that the one chamber is not connected to the volume surrounding the yet further chamber.
Figure 9:
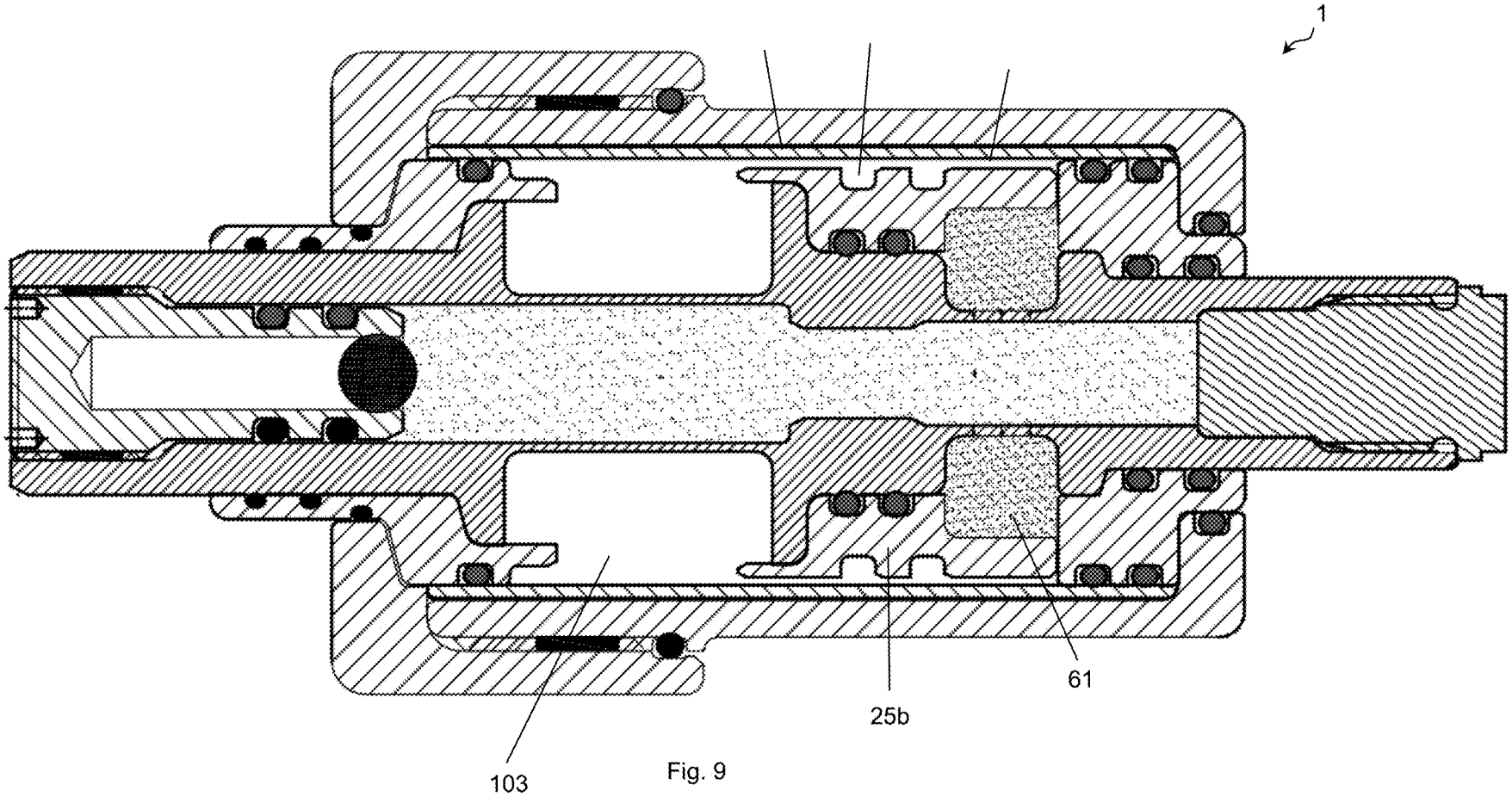
FIG. 9 shows an interruption switch like in FIG. 8, but additionally with circumferential grooves on the sabot.
Figure 10:
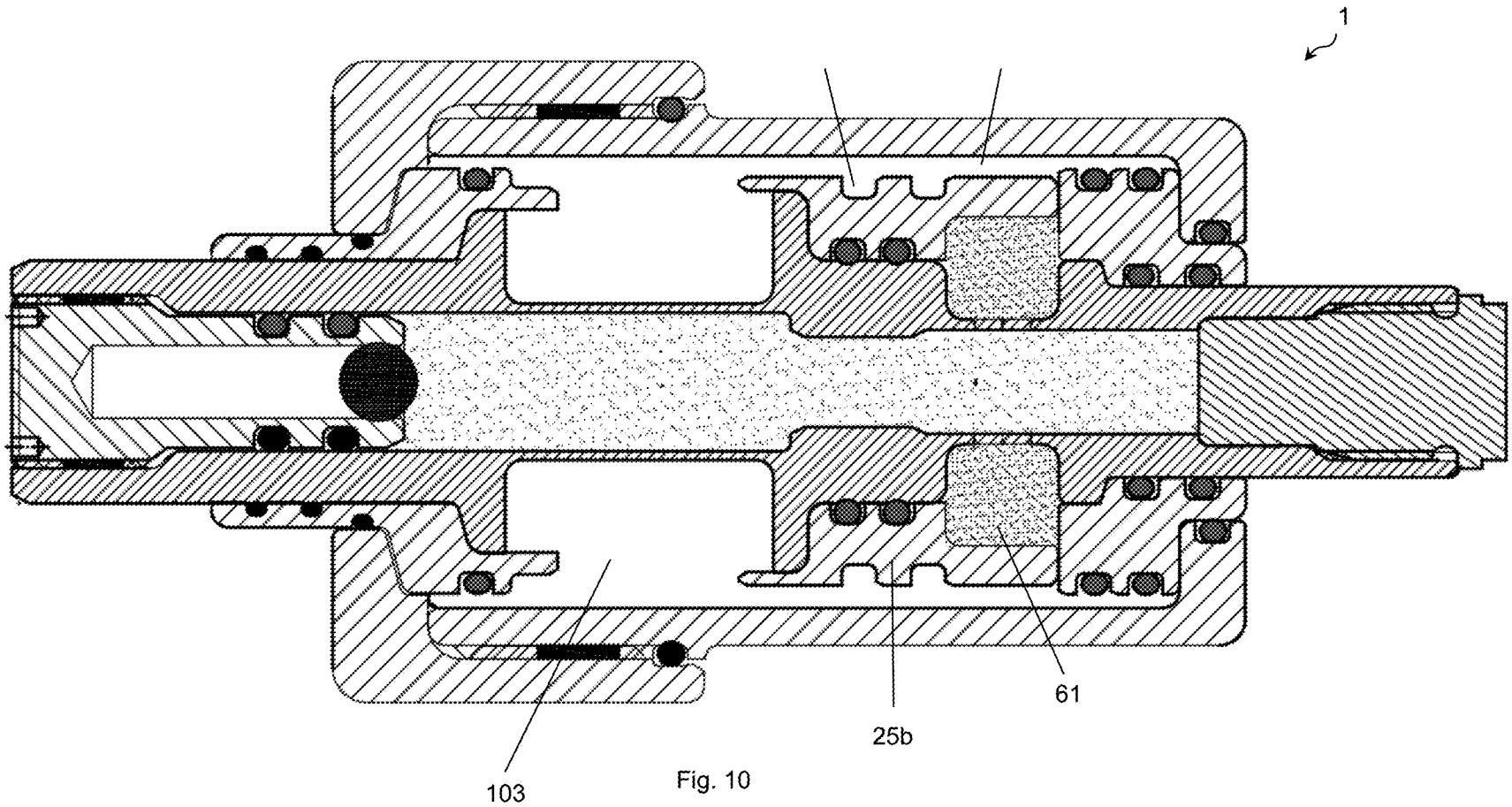
FIG. 10 shows an interruption switch like in FIG. 9, but without internal insulation on the casing.

Interruption switches 1 according to the invention with a gap 101 between the casing 3 and the sabot 25*b* are shown in FIGS. 7 to 10. It is preferred here for the gap 101—viewed in cross section—to be present around the whole circumference of the sabot 25*b*. The gap can connect the one chamber 61 to the volume 103 surrounding the yet further chamber, as shown in FIG. 7. However, the sabot 25*b* can also be designed such that in the initial state (unswitched state) of the interruption switch 1 the one chamber 61 is not connected to the gap 101, as shown in FIGS. 8 to 10. The sabot 25*b* can additionally—viewed in the cross section of the interruption switch—have one or more circumferential grooves 105, which act as a labyrinth seal, as shown in FIGS. 9 and 10. Furthermore, these circumferential grooves 105 in the sabot 25*b* have the effect of a vacuum cleaner for larger particles which are to be removed from the one chamber 61 and the further chamber 63 during the switching operation. In an embodiment of the invention, the sabot 25*b* thus does not contain any sealing rings in the circumferential grooves 105. If, in the case of interruption switches 1 with a gap 101 in the circumferential grooves 105, one or more sealing ring(s) are provided, then these are designed such that it/they can be flushed out by the pressure forming during the switching operation, thus no longer have a sealing action during the switching operation. As already described further above, in an embodiment of the invention it is preferred for no internal insulation to be provided on the casing, as shown in FIG. 10.

LIST OF REFERENCE NUMBERS

1 interruption switch
3 casing
5 contact unit (switch tube)
7 insulation layer (internal insulation)
11 first connection contact
13 second connection contact
15 flange of the switch or contact tube
17 insulator element (insulator 1)
19 sealing element (O-ring)
23 upsetting region
25*a* flange
25*b* sabot
27 separation region
29 flange
31 closure
39 closure element
49 channel
53 closure element
61 chamber
63 further chamber
65 yet further chamber
81 third connection contact
85 protective cap
87 safety fuse
91 circumferential groove(s) (separation region)
93 circumferential thickening (small lump)
95 heat sink 1
97 heat sink 2
101 gap
103 the volume surrounding the yet further chamber
105 circumferential grooves (sabot)
I current
$I_1$ partial current
$I_2$ partial current

The invention claimed is:

1. An interruption switch for interrupting high currents at high voltages comprises:

a casing, which surrounds a contact unit defining a current path through the interruption switch, wherein the contact unit has a first connection contact and a second connection contact, a separation region and a sabot, wherein the contact unit is formed such that a current to be interrupted is supplied to it via the first connection contact and discharged therefrom via the second connection contact, or vice versa, at least one chamber in the interruption switch, at least partially delimited by the separation region, is filled with a vaporizable medium, such that the separation region is in contact with the vaporizable medium, and wherein the separation region, the sabot and the vaporizable medium are formed such that the separation region is separable into at least two parts through a supplied current when a threshold amperage is exceeded, wherein an electric arc forming between the two parts of the separation region vaporizes the vaporizable medium, such that a gas pressure to which the sabot is exposed forms, wherein the sabot in the casing is moved in a movement direction from a starting position into an end position, wherein in the end position of the sabot an insulation spacing is achieved between the first and the second connection contact.

2. The interruption switch according to claim 1, wherein the interruption switch does not contain any activatable means for separating the separation region.

3. The interruption switch according to claim 1, wherein the separation region is formed of a metal configured to form an alloy with a soft solder material.

4. The interruption switch according to claim 1, wherein a substance for capturing or oxidizing elemental carbon is a component of the vaporizable medium.

5. The interruption switch according to claim 1, wherein a substance which reacts exothermically during the formation of the electric arc is a component of the vaporizable medium.

6. The interruption switch according to claim 1, wherein a substance which increases the capacity of the vaporizable medium to absorb mechanical energy is a component of the vaporizable medium.

7. The interruption switch according to claim 1, wherein the separation region includes predetermined breaking points in the form of one or more of narrowings, notches, holes and cross-sectional jumps.

8. The interruption switch according to claim 1, wherein the separation region separates the at least one chamber from a further chamber which surrounds the separation region in a hollow manner.

9. The interruption switch according to claim 8, wherein both the at least one chamber and the further chamber are filled with the vaporizable medium.

10. The interruption switch according to claim 1, wherein the contact unit has an upsetting region.

11. The interruption switch according to claim 10, wherein the upsetting region includes a respective material and a respective geometry such that a wall of the upsetting is folded in a meandering fashion, during movement of the sabot from the starting position into the end position.

12. The interruption switch according to claim 10, wherein the upsetting region is formed hollow-cylindrical or hollow-prismatic, such that upsetting region surrounds a further chamber.

13. The interruption switch according to claim 12, wherein the upsetting region has a perforation, which makes enables a connection between the further chamber and a volume surrounding the further chamber.

14. The interruption switch according to claim 12, wherein the at least one chamber, the further chamber and yet further chamber are filled with the vaporizable medium, wherein the vaporizable medium can be the same or different in the different chambers, wherein the separation region separates the at least one chamber from the yet further chamber which surrounds the separation region in a hollow manner.

* * * * *